United States Patent [19]

Singer

[11] Patent Number: 4,589,408

[45] Date of Patent: May 20, 1986

[54] SURGICAL FACE MASK AND HOOD

[75] Inventor: Wayne J. Singer, Roswell, Ga.

[73] Assignee: Kimberly-Clark Corporation, Neenah, Wis.

[21] Appl. No.: 636,893

[22] Filed: Aug. 2, 1984

Related U.S. Application Data

[63] Continuation of Ser. No. 386,446, Jun. 9, 1982, abandoned.

[51] Int. Cl.[4] ..... A61F 13/00

[52] U.S. Cl. ..... 128/132 R; 128/132 D; 128/201.25; 128/206.19; 128/139; 2/205; 2/193

[58] Field of Search ..... 128/132 R, 132 D, 139, 128/206.19, 205.27, 206.17, 201.25; 2/DIG. 7, 173, 206, 171.2, 205; 55/DIG. 35; 428/157

[56] References Cited

U.S. PATENT DOCUMENTS

| | | | |
|---|---|---|---|
| 1,800,051 | 4/1931 | Blanco | 128/201.25 |
| 1,990,199 | 2/1935 | Nemzek | 2/206 |
| 2,355,283 | 8/1944 | Diss | 2/174 |
| 2,436,249 | 2/1948 | Clement | 128/141 |
| 3,058,463 | 10/1962 | Goodrich, Jr. | 128/139 |
| 3,314,079 | 4/1967 | Stout et al. | 2/173 |
| 3,789,839 | 2/1974 | Lund et al. | 2/206 |
| 3,885,558 | 5/1975 | Belkin | 128/139 |
| 3,943,575 | 3/1976 | Bolker | 128/139 |
| 3,955,570 | 5/1976 | Hutter, III | 128/139 |
| 4,032,991 | 7/1977 | Vandeweghe | 2/173 |
| 4,041,203 | 8/1977 | Brock et al. | 428/157 |
| 4,196,245 | 4/1980 | Kitson et al. | 2/DIG. 7 |

FOREIGN PATENT DOCUMENTS

| | | | |
|---|---|---|---|
| 63495 | 6/1975 | Australia | 128/206.19 |
| 2124071 | 2/1984 | United Kingdom | 2/205 |

*Primary Examiner*—Henry J. Recla
*Assistant Examiner*—Karin M. Reichle
*Attorney, Agent, or Firm*—William D. Herrick

[57] ABSTRACT

A head covering is disclosed having a face mask portion and a rear portion which substantially completely surrounds the head of the wearer and reaches to the neck, where it may be gathered by a length of elastic, and which is formed of a laminated material incorporating, as a layer, a mat of generally discontinuous thermoplastic microfibers and, as a second layer, a web of continuous thermoplastic filaments, the laminated material providing a combination of bacteria barrier and air permeability properties substantially throughout the head covering which is effective for containment of bacteria while retaining air permeability sufficient to allow the wearer to breathe through the material in the face mask portion where the nose and mouth are covered.

5 Claims, 4 Drawing Figures

SURGICAL FACE MASK AND HOOD

This is a continuation of application Ser. No. 386,446, filed June 09, 1982, now abandoned.

TECHNICAL FIELD

This invention relates to surgical face masks and hoods and, more particularly, to surgical face masks and hoods combined to form a head covering for members of the sterile team and others entering a sterile environment.

BACKGROUND ART

Surgical face masks and hoods combined to form complete head coverings have been proposed as a means for preventing contamination of hospital sterile environment by containment of bacteria exhaled by the wearer and bacteria carried by the wearer's head, particularly on the hair. These prior head coverings have been made of cloth or disposable, light weight, nonwoven or cellulosic materials. While the face masks are, in most cases, made of material having bacteria barrier properties, apparently it is generally believed that the larger pored structure of non-woven or cellulosic materials which are opaque and perfectly adequate to restrain the wearer's hair and prevent it from coming into direct contact with any other object in the operating room, are also effective to block the passage of bacteria from the wearer's head into the atmosphere. To some extent the head coverings of the prior art do limit the passage of bacteria into the environment but, as should be clear, these materials which have large pores and are not bacteria filter materials, as such, permit the passage of bacteria from the wearer's head into the material. Such bacteria may pass through the pores of the material into the atmosphere or onto another object the wearer happens to brush against. Members of the sterile team frequently bump heads as they crowd around a patient on an operating table looking into a wound or as they perform their duties and bacteria may be passed from one member to another as a result of such head contact.

DISCLOSURE OF INVENTION

It is the primary aim of this invention to provide head coverings for containment of bacteria to limit the passage of bacteria from persons present in a sterile environment.

A more specific object is to provide a surgical face mask and hood combined to form a complete head covering and having bacteria barrier properties throughout the head covering for containment of bacteria.

A further more specific object is to provide a combined face mask and hood made from a single piece of material having bacteria barrier properties.

Another object is to provide a combined face mask and hood made from separate pieces of material having bacteria barrier properties.

BRIEF DESCRIPTION OF DRAWINGS

These and other objects of the invention will become apparent from the following description taken in connection with the accompanying drawings, in which.

BEST MODE FOR CARRYING OUT THE INVENTION

Figure 1:
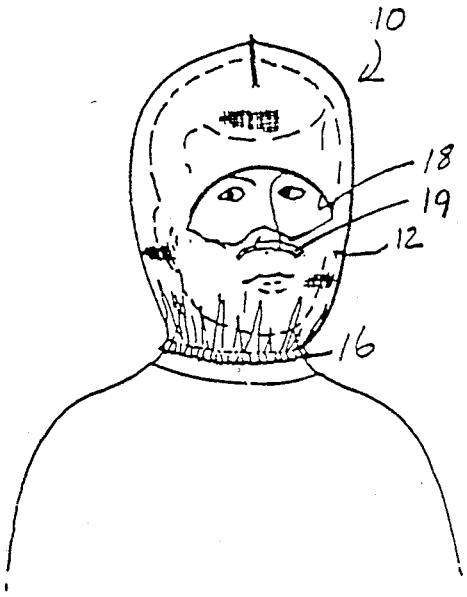
FIG. 1 is a front view of one embodiment of a head covering according to the invention made from a single piece of material incorporating a bacteria barrier.
Figure 2:
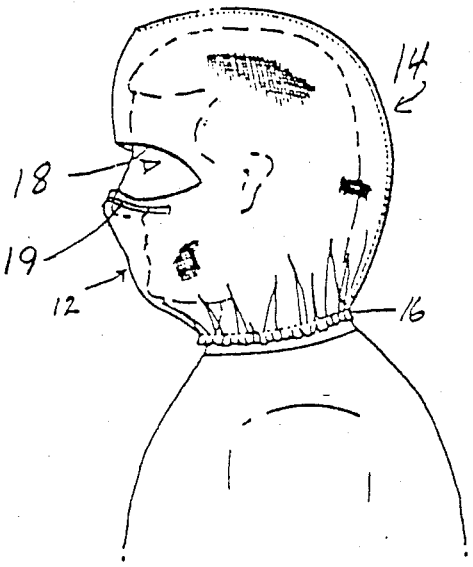
FIG. 2 is a side view of the head covering in FIG. 1.

Turning to the drawings, a head covering 10 is shown in FIGS. 1 and 2 having a face mask portion 12 and a rear portion 14. The head covering 10 substantially completely surrounds the head of the wearer and reaches to the neck, where it may be gathered by a length of elastic 16. An opening in the form of a slit 18 for the eyes is left in the front face mask portion and a piece of soft, bendable light metal 19 may be attached to the material forming the head covering along the bottom edge of the eye slit to rest on the bridge of the nose and hold the face mask portion in place with the slit 18 before the wearer's eyes.

In accordance with the present invention, the head covering 10 is formed of a laminated material incorporating, as a layer, a mat of generally discontinuous thermoplastic microfibers and, as a second layer, a web of continuous thermoplastic filaments, the laminated material providing a combination of bacteria barrier and air permeability properties substantially throughout the head covering 10 which is effective for containment of bacteria while retaining air permeability sufficient to allow the wearer to breathe through the material in the face mask portion 12 where the nose and mouth are covered.

Such a mat of microfibers, having a diameter less than about ten microns, is known to serve as a bacteria barrier. The laminated material for the head covering 10, in carrying out the invention, is prepared in a manner to incorporate the mat of microfibers and provide a bacteria barrier with a biological filtration efficiency rating and an air permeability meeting standards for face masks in sterile hospital environments so that such material may be successfully utilized in the face mask portion 12 of the head covering 10. Furthermore, in keeping with the invention, the laminated material incorporating such a mat of microfibers and providing this same bacteria filtration efficiency and air permeability extends throughout the entire head covering 10 and thus provides a containment for bacteria surrounding the head of the wearer as well as covering the nose and mouth in the face mask portion 12.

It is preferred to utilize, for the material for the head covering, a laminate having a unitary structure incorporating a mat of generally discontinuous, thermoplastic microfibers and, as a second layer, a web of substantially continuous and randomly deposited, molecularly oriented filaments of a thermoplastic polymer. In order to provide a unitary structure, preferably the mat and web are attached at intermittent, discrete bond regions disposed over the surface of the material in a substantially regular pattern. It is preferred that the discrete bond regions be formed by the application of heat and pressure. However, other methods of ply attachment may be used, such as independently applied adhesives or mechanical interlocking of the fibers, accomplished by needling techniques or the like.

The laminated material can be prepared by known techniques such as set forth in commonly assigned Brock and Meitner, U.S. Pat. No. 4,041,203. Basically, the method of formation of the mat of microfibers involves extruding a molten polymeric material into fine streams and attenuating the streams by opposing flows of high velocity, heated gas (usually air) to break the streams into discontinuous fibers of small diameter. Subsequent collection of the fibers on a foraminous screen, belt, drum or the like yields a mat of the microfibers. In general, the microfibers contained in such mats have an average fiber diameter of up to about only 10 microns and usually the average diameter of the microfibers in such mats is about 2–6 microns. While the fibers in the mat are predominantly discontinuous, they generally have a length exceeding that normally associated with staple fibers.

The manner of preparing the web of substantially continuous filaments is also customary. The available methods generally involve extruding a thermoplastic polymer through a spinneret in order to form discrete filaments which are drawn without breaking in order to molecularly orient the polymer filaments and achieve tenacity. The continuous filaments are deposited in a substantially random manner onto a carrier belt or the like to form a web of substantially continuous and randomly arranged, molecularly oriented filaments. As opposed to the microfiber web, the continuous filaments generally have an average fiber diameter in excess of about 12 microns and up to about 55 microns.

Regarding the polymers used in preparing the microfiber mat and continuous filament web, a wide variety of thermoplastic polymers are useful. The mat and web can be prepared from the same or different polymer types and two or more different polymers can be used in the preparation of either the mat or web, or both. Among the many useful thermoplastic polymers, polyolefins, such as polypropylene and polyethylene, polyamides, polyesters are useful for the preparation of the material for the head covering. Particularly preferred are laminated materials formed of polypropylene microfiber mats and polypropylene continuous filament webs, with ply attachment achieved by means of a regular pattern of intermittent heat and pressure bonds formed by passing the mat and web through the nip formed by patterned rolls, as described in said U.S. Pat. No. 4,041,203.

The bonding conditions which, when selected in preparing the material, provide a nonwoven laminated material particularly preferred for head coverings and having the physical properties herein set forth are described in greater detail in U.S. Pat. No. 4,041,203 which is incorporated herein by reference.

After preparation, it may be desired to treat the laminates with an antistatic composition in order to reduce surface resistivity to below about $1\times10^{11}$ ohms/square unit of applied voltage (AATCC Test Method 76:1972). Any number of antistatic compositions can be used for this purpose with the general requirements, in addition to reducing resistivity, being that the composition is non-toxic, does not promote bacterial growth, does not adversely affect sterilent penetration or barrier properties and, if steam sterilization is anticipated, be durable. Many useful compositions are disclosed in "Antistatic Agents, Technology and Applications 1972", Keith Johnson, Noyes Data Corporation, with polymeric amines and salts thereof being particularly useful.

Since many antistatic compositions also exhibit wetting characteristics which can adversely affect liquid repellency, both with respect to water and alcohol, it is frequently desirable to treat the material with a liquid repellent composition in order to avoid moisture transmitted contamination.

When such laminated material is fashioned into head coverings according to the invention, either side may be next to the head. When manufactured as described, neither side of the material tends to be clinging; neither is the material absorbent of moisture such as perspiration.

Figure 3:
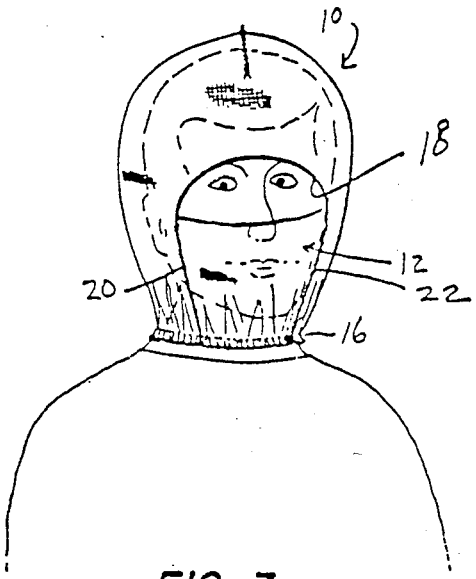
FIG. 3 is a front view of another embodiment of a head covering according to the invention made from two pieces of material incorporating a bacteria barrier.
Figure 4:
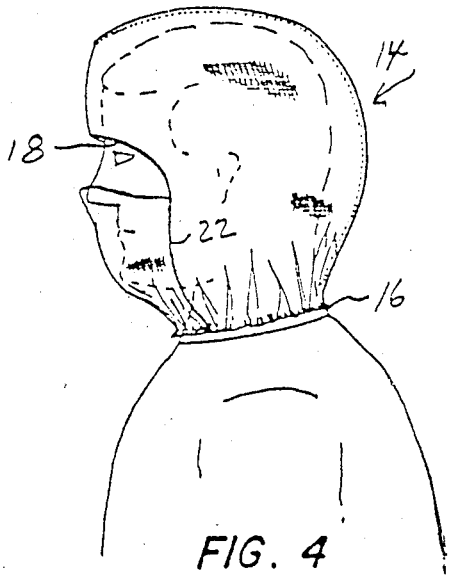
FIG. 4 is a side view of the head covering in FIG. 3.

Referring to FIGS. 3 and 4 another embodiment of the head covering is disclosed in which a face mask portion 12 is formed from a separate piece of material from the rear portion of the head covering. Both portions 12, 14 are fixed together along essentially parallel seams 20, 22. In carrying out the invention, while formed of different pieces of material, both portions of the head covering 10 are formed of a material preferably incorporating, as a layer, a mat of thermoplastic microfibers and, as a second layer, a web of continuous filaments, prepared and intermittently bonded in the manner described above, the material having a combination of biological filtration efficiency and air permeability properties substantially throughout the head covering which is effective for bacteria containment while retaining permeability.

Materials useful for head coverings for sterile environments, such as hospital operating rooms and other locations where surgical or health care procedures are carried out desirably are sterilizable by a sterilent. To be steam sterilizable, the materials must be capable of withstanding 250 degrees–280 degrees F. steam. The preferred materials described herein are capable of withstanding steam at such high temperatures.

It is also well recognized that materials for face masks that cover the mouth and the nose of the wearer must meet. the bacteria filtration efficiency and air permeability standards imposed by law and practice. One standard U. S. Government Military Specification that has been widely adopted as an industry standard for face masks at the present time is M36954C (12 June 1975). This specification sets a minimum rating of 95% for Biological Filtration Efficiency (BFE) measured by standard tests such as the Nicholes test. It also sets an air permeability requirement in terms of pressure drop ($\Delta P$) of equal to or less than five millimeters of water ($\Delta P \leqq 5$ mm.) measured by standard tests.

TABLE 1

| Material | Example 1<br>.4 oz fil.<br>.9 oz microfiber |
|---|---|
| BFE | 98.73 |
| $\Delta P$ | 3.54 |

TABLE 2

| | Example | | |
|---|---|---|---|
| | 1 | 2 | 3 |
| Material | .5 oz fil.<br>.8 oz microfiber | .7 oz fil.<br>.6 oz microfiber | 1.5 oz fil.<br>.6 oz microfiber |
| BFE | 92.44 | 79.16 | 98.82 |
| $\Delta P$ | 5.00 | 2.50 | 8.13 |

In accordance with this invention, laminated materials prepared as herein described are exceptionally useful for surgical hoods and face masks combined to form complete head coverings. Such laminated materials have a combination of high biological filtration efficiency (BFE>95%) and high permeability ($\Delta P \leqq 5$ mm.) and meet the established standards for face masks. To achieve this combination of properties requires the balance of increasing bacteria filtration against decreasing permeability as bond area, microfiber and filament content is increased. While the continuous filament content of the material also affects both bacteria filtration and permeability at light basis weights, the contribution of the continuous filament layer is primarily to impart strength and abrasion resistance to the laminated material. The microfiber mat layer, in and of itself in an unbonded state, is very tenuous and weak and has insufficient strength and integrity to serve as a head covering material that meets reasonable commercial standards. It is also not completely uniform in appearance as formed, which detracts from its suitability, bonded or unbonded, in such applications. Particular weights of microfiber mats and filament webs, attached by intermittent bonds, possess the desired biological and permeability properties as well as a combination of strength characteristics and textile-like drapability required for head coverings according to this invention.

In order to provide a laminated material suitable for head coverings and having the required balance of bacteria filtration and permeability, as well as strength, abrasion resistance and textile-like drape and hand, it has been found preferable to combine a mat of microfibers having a basis weight of about 0.9 ounce/yd$^2$ with a continuous filament web of about 0.4 ounce/yd$^2$ and providing a total basis weight of about 1.3 ounce/yd$^2$. The mats and webs are preferably prepared in the manner described above and intermittently heat and pressure bonded. Such a material provides a ΔBFE of 98.73% and a P of 3.54, as indicated for example 1 in Table 1, and also is light-weight and otherwise has the desirable attributes of a surgical head covering material. While the microfiber content is believed to be optimum at about 0.9 ounce/yd$^2$ basis weight, microfiber mats up to about 1.25 ounce/yd$^2$ may be used. The lower basis weight mats provide satisfactory properties, particularly when composed of finer microfibers, while higher basis weight mats may be satisfactory when composed of coarser microfibers. Also, the continuous filament web content may be increased to about 1 ounce/yd$^2$, although the degree of stiffness may be objectionable at the higher total basis weights approaching a maximum of about 1.9 ounce/yd$^2$. Lower basis weight material, about 1.3 ounce/yd$^2$ total, is preferred where the mat microfibers have an average diameter of between about 2–4 microns and a maximum diameter of about 10 microns.

As examples of materials which incorporate mats of microfibers and which are unsuitable for making head coverings according to this invention, reference is made to Table 2. In this Table, test data is provided for examples 1 and 2, both of which are laminated materials prepared in the manner described above and incorporating a mat of microfibers. In example 1, the mat of microfibers has a basis weight of about 0.8 ounce/yd$^2$ with a continuous filament web of 0.5 ounce/yd$^2$, having a total basis weight of about 1.3 ounce/yd$^2$, the same as the preferred material. As indicated in Table 2, while the air exchange or permeability property of this material is satisfactory ($\Delta P \cong 5$ mm.), the bacteria barrier property is too poor to meet acceptable standards (BFE=92.44%).

Another unsatisfactory material is example 2, which has a total basis weight of 1.3 ounce/yd$^2$ incorporating a mat of microfibers of 0.6 ounce/yd$^2$ and a continuous filament web of 0.7 ounce/yd$^2$. In this case, the bacteria barrier property is below standard (BFE=79.16%) and lower than for example 2, while the air permeability property is satisfactory.

An illustration of the effect of using heavier basis weight continuous filament webs is example 3 in Table 2. This material includes a microfiber mat of the same basis weight, 0.6 ounce/yd$^2$, as in example 2, and a heavier basis weight continuous filament web of 1.5 ounce/yd$^2$, providing a total basis weight of 2.1 ounce/yd$^2$. While the bacteria barrier property has been raised to a satisfactory level (BFE=97.52%) by the addition of a heavier basis weight continuous filament web, the air permeability has been reduced so that the material is unsatisfactory for use in the face mask area ($\Delta P = 8.13$). It is clear from this example that heavier basis weight continuous filament webs do function as a bacteria barrier. This is believed to be the result of the pattern bonding, which results in film-like bonded areas and the randomness of the web which results in a dense matrix providing a long tortuous path from one side of the material to the other. However, the air permeability is also reduced, apparently due to the same film-like bonded areas and dense matrix of filaments. Thus, while heavy basis weight continuous filament web might assist in providing satisfactory bacteria barrier properties, a satisfactory combination of bacteria barrier and air permeability properties is preferably achieved with light basis weight microfiber mat (less than 1.25 ounce/yd$^2$) attached to light weight continuous filament web. Such materials constructed in accordance with this invention provide other desirable attributes of strength, drape and hand, making such materials preferred for head covering use.

I claim:

1. A combined surgical face mask and hood comprised of material and forming a head covering adapted to substantially completely surround the head of a wearer except for an opening adapted to lie over the eyes of the wearer and including a face mask portion adapted to cover the mouth and nostrils and provide a filter through which the wearer breaths, said head covering also being adapted to reach to the neck of the wearer, and further including means for holding the head covering on the wearer with said face mask portion against the wearer's face and in position covering the mouth and nostrils, said head covering material being formed of a laminated material including a layer of substantially continuous, randomly deposited, thermoplastic polymer filaments having a diameter greater than about 12 microns and a mat of thermoplastic polymer microfibers having an average diameter of about 2–4 microns, said microfiber mat having a basis weight between about 0.9 ounce/yd$^2$ and about 1.25 ounce/yd$^2$, said layer and mat being intermittently bonded together to provide a laminated material having a basis weight between about 1.3 ounce/yd$^2$ and about 1.7 ounce/yd$^2$, the combination of said mat and said layer being selected to provide substantially throughout said head covering a combination of bacteria biological efficiency BFE$\geqq$95% and air permeability of $\Delta P > 5$ mm, and textile like drape and hand.

2. A surgical face mask and hood combined according to claim 1 whereln said microfibers are composed of polypropylene.

3. A surgical face mask and hood combined according to claim 1 wherein said microfibers and said filaments are composed of polypropylene.

4. A surgical face mask and hood combined according to claim 1, said laminated material having a surface resistivity below about $1\times10^{11}$ ohms/square unit of applied voltage.

5. A combined surgical face mask and hood comprised of material and forming a head covering adapted to substantially completely surround the head of a wearer except for an opening adapted to lie over the eyes of the wearer and including a section adapted to cover the mouth and nostrils and provide a filter through which the wearer breaths, said head covering also being adapted to reach to the neck of the wearer, and further including means for holding the head covering on the wearer with said face mask portion against the wearer's face and in position covering the mouth and nostrils, said head covering material being formed of a laminated nonwoven material including a layer of substantially continuous, randomly deposited, thermoplastic polymer filaments and a mat of thermoplastic polymer microfibers having an average diameter less than about ten microns, said microfiber mat having a basis weight between about 0.9 ounce/yd$^2$ and about 1.25 ounce/yd$^2$, said layer and mat being intermittently bonded together to provide a laminated material having a basis weight between about 1.3 ounce/yd$^2$ and about 1.9 ounce/yd$^2$, the combination of said layer and mat being selected to provide substantially throughout said head covering a combination of bacteria biological efficiency BFE$\geqq$95% and air permeability $\Delta P\leqq5$ mm.

* * * * *

UNITED STATES PATENT AND TRADEMARK OFFICE

CERTIFICATE OF CORRECTION

PATENT NO. : 4,589,408

DATED : May 20, 1986

INVENTOR(S) : Wayne J. Singer

It is certified that error appears in the above—identified patent and that said Letters Patent is hereby corrected as shown below:

Column 3, line 59 and Column 4, line 9, "sterilent" should read --sterilant--

Column 4, line 9 "4 another" should read --4, another--

Column 4, line 35 "meet.the" should read --meet the--

Column 4, line 68 "BFE>95%" should read --BFE$\geqq$95%--

Column 5, line 32 "$\Delta$BFE" should read --BFE--

Column 5, line 33 "P" should read --$\Delta$P--

Column 6, line 31 "web." should read --webs.--

Column 6, line 42 and column 7, line 11 "breaths" should read --breathes--

Column 6, line 61 "$\Delta$P>5" should read --P$\leqq$5--

Column 6, line 64 "whereln" should read --wherein--

Signed and Sealed this

Tenth Day of February, 1987

*Attest:*

DONALD J. QUIGG

*Attesting Officer*

*Commissioner of Patents and Trademarks*